US011808057B2

(12) United States Patent
Tikkanen et al.

(10) Patent No.: US 11,808,057 B2
(45) Date of Patent: Nov. 7, 2023

(54) ELECTROMECHANICAL LOCK UTILIZING MAGNETIC FIELD FORCES

(71) Applicant: iLOQ Oy, Oulu (FI)

(72) Inventors: Väinö Tikkanen, Oulu (FI); Mauri Arvola, Oulu (FI)

(73) Assignee: ILOQ OY, Oulu (FI)

( * ) Notice: Subject to any disclaimer, the term of this patent is extended or adjusted under 35 U.S.C. 154(b) by 178 days.

(21) Appl. No.: 16/760,266

(22) PCT Filed: Nov. 2, 2018

(86) PCT No.: PCT/EP2018/079967
§ 371 (c)(1),
(2) Date: Apr. 29, 2020

(87) PCT Pub. No.: WO2019/086587
PCT Pub. Date: May 9, 2019

(65) Prior Publication Data

US 2020/0291683 A1 Sep. 17, 2020

(30) Foreign Application Priority Data

Nov. 2, 2017 (EP) ..... 17199659

(51) Int. Cl.
*E05B 47/00* (2006.01)
*E05B 47/06* (2006.01)

(52) U.S. Cl.
CPC ..... *E05B 47/0006* (2013.01); *E05B 47/0038* (2013.01); *E05B 47/0611* (2013.01);
(Continued)

(58) Field of Classification Search
CPC ..... Y10T 292/1082; Y10T 292/11; E05B 47/0006; E05B 47/0038; E05B 47/0611;
(Continued)

(56) References Cited

U.S. PATENT DOCUMENTS 2,787,154 A * 4/1957 Wesberry ..... E05C 9/048 70/118
3,596,958 A * 8/1971 Bowerman ..... E05B 47/004 292/201

(Continued)

FOREIGN PATENT DOCUMENTS

CA 2681141 A1 * 1/2008 ..... A44B 11/2511
CH 478323 A * 8/1966 ..... E05B 47/0038

(Continued)

OTHER PUBLICATIONS

FR2821380A1, Espacenet machine translation of description and claims, Aug. 30, 2002 (Year: 2023).*

(Continued)

*Primary Examiner* — Kristina R Fulton
*Assistant Examiner* — Steven A Tullia
(74) *Attorney, Agent, or Firm* — Nixon & Vanderhye PC

(57) ABSTRACT

Electromechanical lock utilizing magnetic field forces. An actuator is moved (1202) from a locked position (260) to an open position (400) by electric power. In the locked position (260), a permanent magnet arrangement directs (1204) a near magnetic field to block an access control mechanism to rotate, and simultaneously the permanent magnet arrangement attenuates (1206) the near magnetic field towards a far magnetic break-in field originating from outside of the electromechanical lock. In the open position (400), the permanent magnet arrangement directs (1208) a reversed near magnetic field to release the access control mechanism to rotate, and simultaneously the permanent magnet arrangement attenuates (1210) the reversed near magnetic field towards the far magnetic break-in field.

19 Claims, 10 Drawing Sheets

(52) U.S. Cl.
CPC .. *E05B 47/0673* (2013.01); *E05B 2047/0092* (2013.01); *E05Y 2201/42* (2013.01); *E05Y 2201/462* (2013.01); *E05Y 2900/132* (2013.01)

(58) Field of Classification Search
CPC ..... E05B 47/0673; E05B 2047/0092; E05B 47/004; E05B 47/0041; E05B 19/26; E05Y 2201/42; E05Y 2201/462; E05Y 2900/132
See application file for complete search history.

(56) References Cited

U.S. PATENT DOCUMENTS

| | | | | | |
|---|---|---|---|---|---|
| 3,782,147 | A * | 1/1974 | Hallmann | E05B 47/0042 | 70/276 |
| 3,837,195 | A * | 9/1974 | Pelto | E05B 47/0038 | 70/276 |
| 3,967,480 | A * | 7/1976 | Stackhouse | E05B 47/0041 | 70/276 |
| 4,802,352 | A * | 2/1989 | Andreoli | E05B 17/04 | 70/118 |
| 5,124,696 | A * | 6/1992 | Bosley | G07C 9/215 | 340/5.73 |
| 5,479,151 | A * | 12/1995 | Lavelle | E05B 65/108 | 340/545.7 |
| 6,474,120 | B1 * | 11/2002 | Wadsworth | E05B 63/185 | 70/276 |
| 9,051,764 | B1 * | 6/2015 | Rafter | E05B 65/0067 | |
| 9,245,677 | B2 * | 1/2016 | Fullerton | H01F 7/021 | |
| 2003/0136162 | A1 * | 7/2003 | Sutton | E05B 47/0623 | 70/276 |
| 2004/0239121 | A1 * | 12/2004 | Morris | E05B 13/004 | 292/39 |
| 2005/0179267 | A1 * | 8/2005 | Cote | E05B 47/0688 | 292/336.3 |
| 2007/0007775 | A1 * | 1/2007 | Gallas | E05C 19/16 | 292/251.5 |
| 2007/0138806 | A1 * | 6/2007 | Ligtenberg | G06F 1/1613 | 292/251.5 |
| 2008/0169890 | A1 * | 7/2008 | Irwin | E05B 47/0002 | 335/228 |
| 2009/0230704 | A1 * | 9/2009 | Goddard | E05C 19/163 | 292/251.5 |
| 2012/0131967 | A1 * | 5/2012 | Sanchez | E05B 47/0038 | 70/276 |
| 2014/0035302 | A1 * | 2/2014 | Koch | E05B 17/0029 | 292/341.17 |
| 2014/0077910 | A1 * | 3/2014 | Chaizy | H01F 7/04 | 335/295 |
| 2014/0306463 | A1 * | 10/2014 | Ho | E05C 19/16 | 292/251.5 |
| 2015/0070119 | A1 * | 3/2015 | Rihn | E05C 19/16 | 335/295 |
| 2015/0187480 | A1 * | 7/2015 | Chaizy | H01F 7/0263 | 403/66 |
| 2016/0290005 | A1 * | 10/2016 | Goldenson | G01D 5/14 | |
| 2016/0290010 | A1 * | 10/2016 | Ciecha | E05B 47/0045 | |
| 2016/0290011 | A1 * | 10/2016 | Gentile | E05B 47/0045 | |

FOREIGN PATENT DOCUMENTS

| | | | | | |
|---|---|---|---|---|---|
| CN | 101163761 | B1 * | 10/2009 | E05F 3/18 | |
| CN | 106320838 | A * | 1/2017 | A44B 11/2511 | |
| CN | 107083884 | A * | 8/2017 | E05C 9/021 | |
| DE | 2552230 | A1 * | 11/1975 | E05B 47/0044 | |
| DE | 19911894 | A1 * | 9/2000 | E05C 9/021 | |
| DE | 19929742 | A1 * | 12/2000 | E05C 9/066 | |
| DE | 202005016459 | U1 * | 3/2006 | E05B 35/007 | |
| DE | 202007015503 | U1 * | 3/2009 | E05C 9/021 | |
| DE | 10 2008 018297 | | 10/2009 | | |
| DE | 102009049005 | A1 * | 4/2011 | E05B 47/004 | |
| DE | 202012104312 | U1 * | 11/2012 | E05C 9/041 | |
| DE | 202012012668 | U1 * | 12/2013 | E05B 15/0073 | |
| DE | 202013104877 | U1 * | 12/2013 | E05C 9/041 | |
| EP | 0207869 | A1 * | 1/1987 | E05C 9/041 | |
| EP | 0665353 | A1 * | 8/1995 | E05B 63/04 | |
| EP | 1130205 | A1 * | 9/2001 | E05C 9/041 | |
| EP | 1 443 162 | | 8/2004 | | |
| EP | 2017415 | A2 * | 1/2009 | E05C 9/041 | |
| EP | 2 248 971 | | 11/2010 | | |
| EP | 2 302 149 | | 3/2011 | | |
| EP | 1746229 | B1 * | 3/2011 | E05B 15/0073 | |
| EP | 2302149 | A1 * | 3/2011 | E05B 47/0038 | |
| EP | 2998483 | A1 * | 3/2016 | E05B 47/0615 | |
| EP | 3 118 977 | | 1/2017 | | |
| FR | 2570744 | A1 * | 3/1986 | E05C 9/041 | |
| FR | 2653155 | A1 * | 4/1991 | E05C 9/041 | |
| FR | 2722826 | A1 * | 1/1996 | E05C 9/041 | |
| FR | 2821380 | A1 * | 8/2002 | E05B 15/004 | |
| FR | 2 945 065 | | 11/2010 | | |
| GB | 2257745 | A * | 1/1993 | E05C 9/041 | |
| GB | 2303166 | A * | 2/1997 | E05C 9/041 | |
| GB | 2474078 | A * | 4/2011 | E05B 11/00 | |
| JP | H01-299970 | | 12/1989 | | |
| JP | 2000-331824 | | 11/2000 | | |
| KR | 200373366 | Y1 * | 10/2004 | E05B 47/004 | |
| KR | 101764871 | B1 * | 12/2016 | E05B 11/00 | |
| WO | WO-9503468 | A1 * | 2/1995 | E05F 15/40 | |
| WO | WO-2009000008 | A1 * | 12/2008 | E05B 47/0038 | |
| WO | WO-2009069508 | A1 * | 6/2009 | B60R 25/04 | |
| WO | WO-2014168236 | A1 * | 10/2014 | H01F 7/122 | |
| WO | WO-2017158544 | A1 * | 9/2017 | A01K 1/0613 | |

OTHER PUBLICATIONS

International Search Report and Written Opinion of the ISA for PCT/EP2018/079967, dated Feb. 4, 2019, 12 pages.
International Preliminary Report on Patentability for PCT/EP2018/079967, dated Sep. 25, 2019, 13 pages.
Office Action dated May 7, 2021 in corresponding Japanese Application No. 2020-524067, 4 pages.

* cited by examiner

ELECTROMECHANICAL LOCK UTILIZING MAGNETIC FIELD FORCES

This application is the U.S. national phase of International Application No. PCT/EP2018/079967 filed 2 Nov. 2018, which designated the U.S. and claims priority to EP Patent Application NO. 17199659.8 filed 2 Nov. 2017, the entire contents of each of which are hereby incorporated by reference.

FIELD

The invention relates to an electromechanical lock, and to a method in an electromechanical lock.

BACKGROUND

Electromechanical locks are replacing traditional locks. Further refinement is needed for making the electromechanical lock to consume as little electric energy as possible, and/or improving the break-in security of the electromechanical lock, and/or simplifying the mechanical structure of the electromechanical lock.

EP 3118977 describes an electromechanical lock utilizing magnetic field forces.

EP 2302149 discloses a lock cylinder utilizing a first drive magnet and a second compensation magnet against external magnetic fields.

DE 102008018297 discloses a lock cylinder utilizing opposite poles of an actuator magnet and two stationary permanent magnets.

EP 1443162 discloses a lock cylinder utilizing by an axial motion two permanent magnets.

EP 2248971 and FR 2945065 disclose a lock utilizing an electromagnet to move an arm with one permanent magnet at each end.

BRIEF DESCRIPTION

The present invention seeks to provide an improved electromechanical lock, and an improved method in an electromechanical lock.

According to an aspect of the present invention, there is provided an electromechanical lock as specified in claim 1.

According to another aspect of the present invention, there is provided a method in an electromechanical lock as specified in claim 11.

LIST OF DRAWINGS

Example embodiments of the present invention are described below, by way of example only, with reference to the accompanying drawings, in which FIGS. 1 and 7 illustrate example embodiments of an electromechanical lock;

DESCRIPTION OF EMBODIMENTS

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments.

Furthermore, words "comprising" and "including" should be understood as not limiting the described embodiments to consist of only those features that have been mentioned and such embodiments may contain also features/structures that have not been specifically mentioned.

The Applicant, iLOQ Oy, has invented many improvements for the electromechanical locks, such as those disclosed in various EP and US patent applications/patents, incorporated herein as references in all jurisdictions where applicable. A complete discussion of all those details is not repeated here, but the reader is advised to consult those applications.

Figure 1:
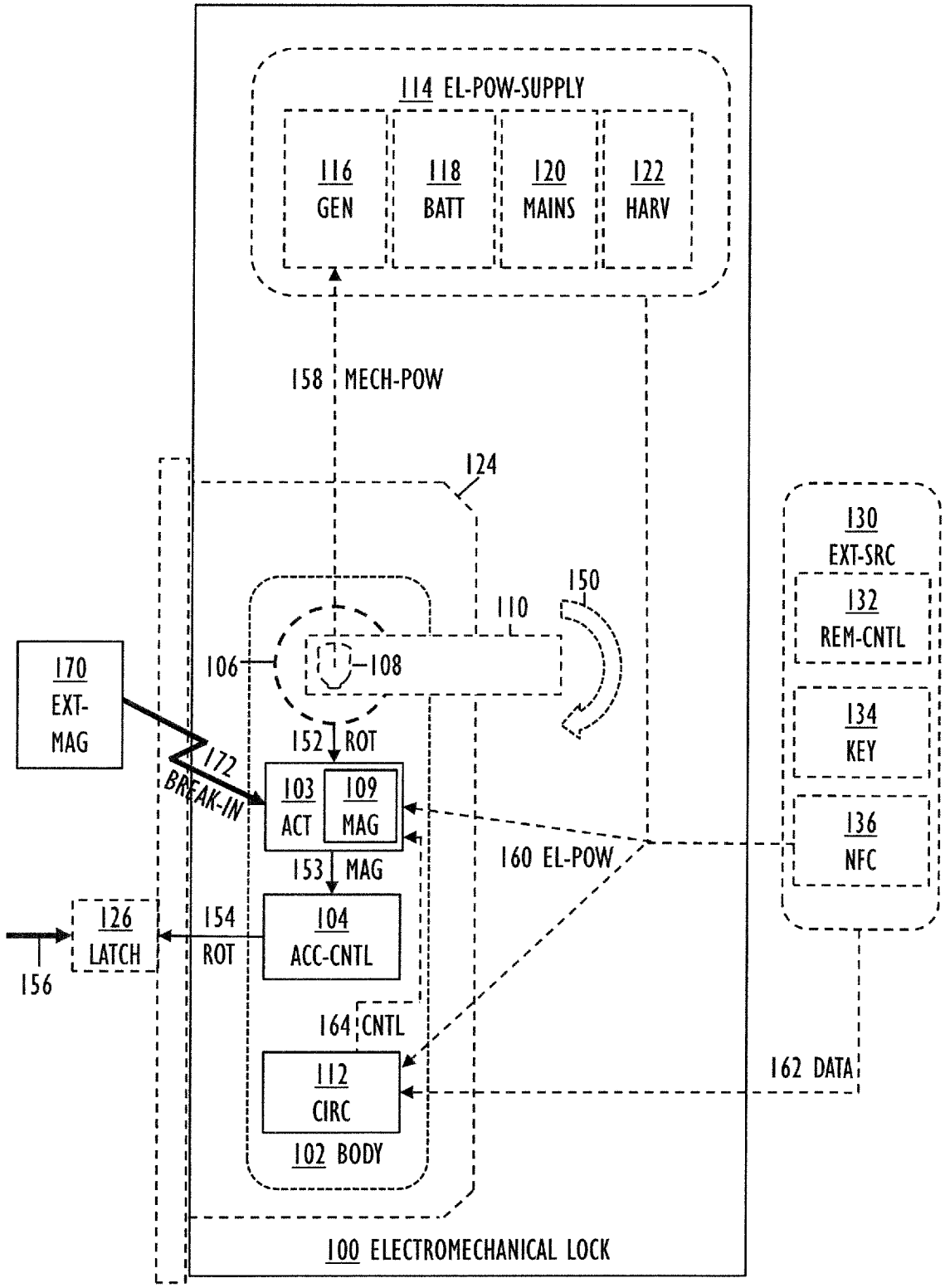
Figure 7:
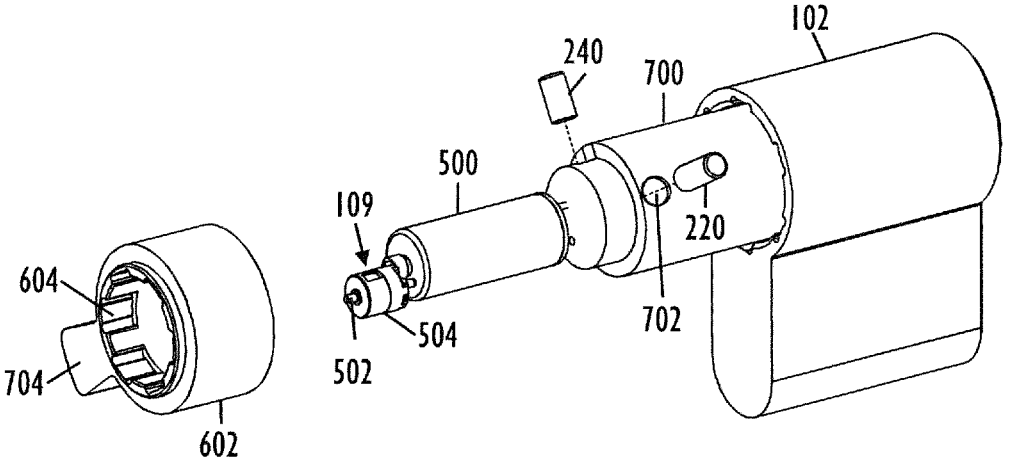

Let us now turn to FIGS. 1 and 7, which illustrate example embodiments of an electromechanical lock 100, but with only such parts shown that are relevant to the present example embodiments.

The electromechanical lock 100 comprises an electronic circuit 112 configured to read data 162 from an external source 130 and match the data 162 against a predetermined criterion. In an example embodiment, besides reading, the electronic circuit 112 may also write data to the external source 130.

The electromechanical lock 100 also comprises an actuator 103 comprising a permanent magnet arrangement 109 movable from a locked position to an open position by electric power.

The electromechanical lock 100 also comprises an access control mechanism 104 configured to be rotatable 152 by a user.

In the locked position, the permanent magnet arrangement 109 is configured and positioned to direct a near magnetic field 153 to block the access control mechanism 104 to rotate, and simultaneously the permanent magnet arrangement 109 is configured and positioned to attenuate the near magnetic field 153 towards a far magnetic break-in field 172 originating from outside 170 of the electromechanical lock 100.

In the open position, the permanent magnet arrangement 109 is configured and positioned to direct a reversed near magnetic field 153 to release the access control mechanism 104 to rotate, and simultaneously the permanent magnet arrangement 109 is configured and positioned to attenuate the reversed near magnetic field 153 towards the far magnetic break-in field 172.

In an example embodiment, the far magnetic break-in field 172 is generated by a powerful external magnet 170, such as a permanent magnet or an electromagnet, used by an unauthorized user such as a burglar, for example.

In an example embodiment shown in FIG. 1, the electronic circuit 112 electrically controls 164 the access control mechanism 104.

In an example embodiment, an electric power supply 114 powers 160 the actuator 103 and the electronic circuit 112.

In an example embodiment, the electric energy 160 is generated in a self-powered fashion within the electromechanical lock 100 so that the electric power supply 114 comprises a generator 116.

In an example embodiment, rotating 150 a knob 106 may operate 158 the generator 116.

In an example embodiment, pushing down 150 a door handle 110 may operate 158 the generator 116.

In an example embodiment, rotating 150 a key 134 in a keyway 108, or pushing the key 134 into the keyway 108, may operate 158 the generator 116.

In an example embodiment, rotating 150 the knob 106, and/or pushing down 150 the door handle 110, and/or rotating 150 the key 134 in the keyway 108 may mechanically affect 152, such as cause rotation of, the access control mechanism 104 (via the actuator 103).

In an example embodiment, the electric power supply 114 comprises a battery 118. The battery 118 may be a single use or rechargeable accumulator, possibly based on at least one electrochemical cell.

In an example embodiment, the electric power supply 114 comprises mains electricity 120, i.e., the electromechanical lock 100 may be coupled to the general-purpose alternating-current electric power supply, either directly or through a voltage transformer.

In an example embodiment, the electric power supply 114 comprises an energy harvesting device 122, such as a solar cell that converts the energy of light directly into electricity by the photovoltaic effect.

In an example embodiment, the electric energy 160 required by the actuator 103 and the electronic circuit 112 is sporadically imported from some external source 130.

In an example embodiment, the external source 130 comprises a remote control system 132 coupled in a wired or wireless fashion with the electronic circuit 112 and the actuator 103.

In an example embodiment, the external source 130 comprises NFC (Near Field Communication) technology 136 containing also the data 162, i.e., a smartphone or some other user terminal holds the data 162. NFC is a set of standards for smartphones and similar devices to establish radio communication with each other by touching them together or bringing them into close proximity. In an example embodiment, the NFC technology 136 may be utilized to provide 160 the electric energy for the actuator 103 and the electronic circuit 112. In an example embodiment, the smartphone or other portable electronic device 136 creates an electromagnetic field around it and an NFC tag embedded in electromechanical lock 100 is charged by that field. Alternatively, an antenna with an energy harvesting circuit embedded in the electromechanical lock 100 is charged by that field, and the charge powers the electronic circuit 112, which emulates NFC traffic towards the portable electronic device 136.

In an example embodiment, the external source 130 comprises the key 134 containing the data 120, stored and transferred by suitable techniques (for example: encryption, RFID, iButton® etc.).

As shown in FIG. 1, in an example embodiment, the electromechanical lock 100 may be placed in a lock body 102, and the access control mechanism 104 may control 154 a latch (or a lock bolt) 126 moving in 156 and out (of a door fitted with the electromechanical lock 100, for example).

In an example embodiment, the lock body 102 is implemented as a lock cylinder, which may be configured to interact with a latch mechanism 124 operating the latch 126.

In an example embodiment, the actuator 103, the access control mechanism 104 and the electronic circuit 112 may be placed inside the lock cylinder 102.

Although not illustrated in FIG. 1, the generator 116 may be placed inside the lock cylinder 102 as well.

In an example embodiment illustrated in FIG. 7, the actuator 103 also comprises a moving shaft 502 coupled with the permanent magnet arrangement 109. The moving shaft 502 is configured to move the permanent magnet arrangement 109 from the locked position to the open position by the electric power. As shown in FIG. 7, the permanent magnet arrangement 109 may be coupled with a drive head 504 coupled with the moving shaft 502. In the shown example embodiments, the moving shaft 502 is a rotating shaft.

In an example embodiment illustrated also in FIG. 7, the actuator 103 comprises a transducer 500 that accepts electric energy and produces the kinetic motion for the moving shaft 502. In an example embodiment, the transducer 500 is an electric motor, which is an electrical machine that converts electrical energy into mechanical energy. In an example embodiment, the transducer 500 is a stepper motor, which may be capable of producing precise rotations. In an example embodiment, the transducer 500 is a solenoid, such as an electromechanical solenoid converting electrical energy into the kinetic motion.

Now that the general structure of the electromechanical lock 100 has been described, let us next study its operation, especially related to the actuator 103 in more detail with reference FIGS. 2A, 2B, 4A and 4B.

Figure 2A:
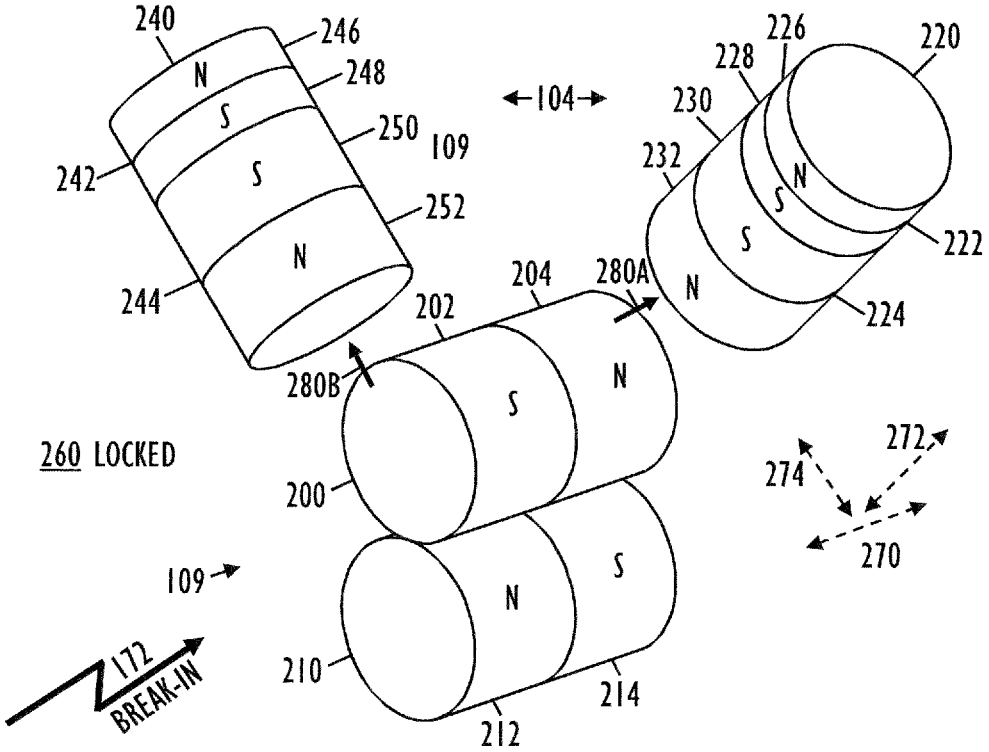
FIGS. 2A, 2B, 3A, 3B, 4A, 4B, 5A, 5B, 5C, 6A and 6B illustrate example embodiments of an opening sequence.
Figure 2B:
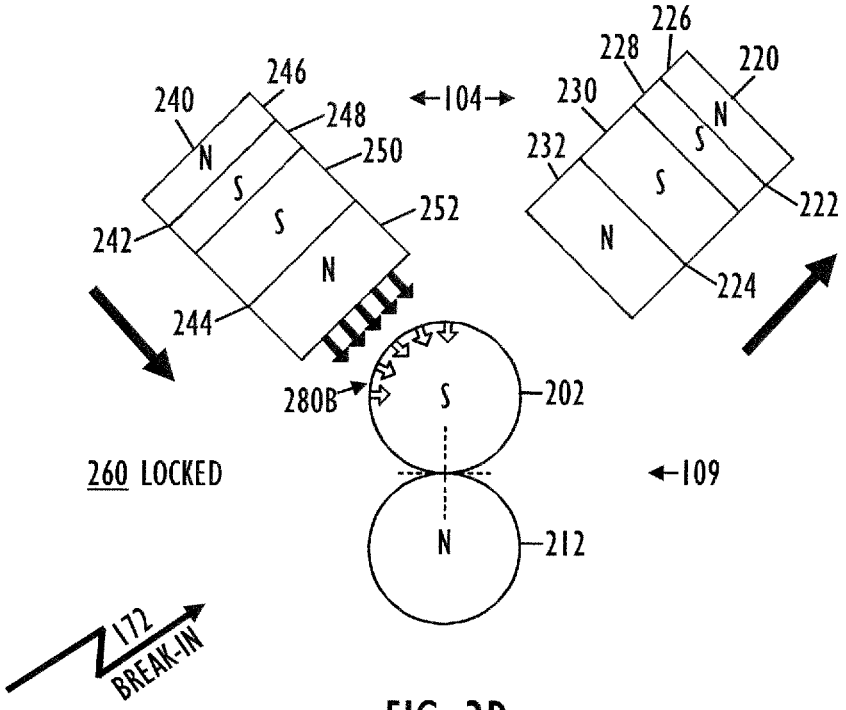
Figure 4A:
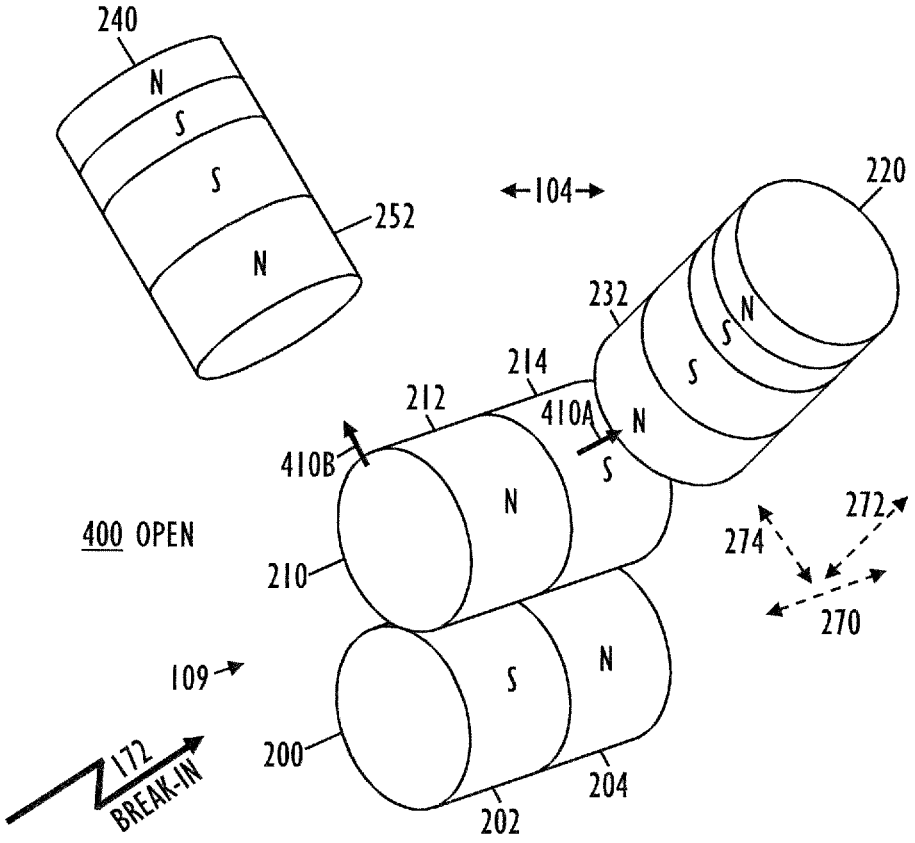
Figure 4B:
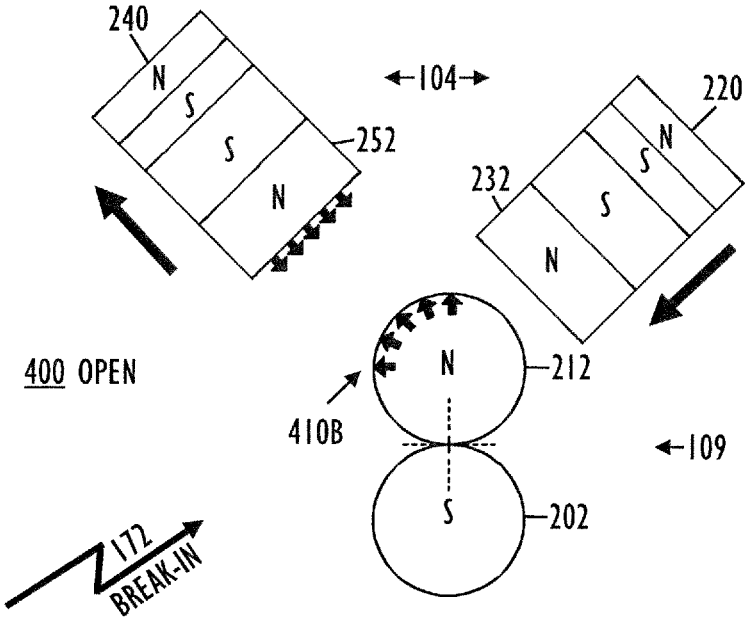

FIGS. 2A and 2B show the permanent magnet arrangement 109 in a locked position 260, whereas FIGS. 4A and 4B show the permanent magnet arrangement 109 in an open position 400.

As was mentioned earlier, the permanent magnet arrangement 109 interacts with the access control mechanism 104 through magnetic forces 153.

In an example embodiment, the permanent magnet arrangement 109 comprises a first permanent magnet 200 and a second permanent magnet 210 configured and positioned side by side so that opposite poles 204/214, 202/212 of the first permanent magnet 200 and the second permanent magnet 210 are side by side.

In an example embodiment of FIGS. 2A and 2B, in the locked position 260, the first permanent magnet 200 is configured and positioned nearer to the access control mechanism 104 than the second permanent magnet 210 so that the near magnetic field 280A, 280B is directed to block the access control mechanism 104 to rotate. Simultaneously, the second permanent magnet 210 is configured and positioned to diminish the near magnetic field 280A, 280B towards the far magnetic break-in field 172.

In an example embodiment of FIGS. 4A and 4B, in the open position 400, the second permanent magnet 210 is configured and positioned nearer to the access control mechanism 104 than the first permanent magnet 200 so that the reversed near magnetic field 410A, 410B is directed to release the access control mechanism 104 to rotate. Simultaneously, the first permanent magnet 200 is configured and positioned to diminish the reversed near magnetic field towards the far magnetic break-in field 172.

In an example embodiment, the electromechanical lock 100 comprises the first permanent magnet 200 and the second permanent magnet 210 as separate permanent magnets fixed to each other. With this example embodiment, the permanent magnet arrangement 109 may be implemented by selecting suitable stock permanent magnets with appropriate magnetic fields and forces. A permanent magnet is an object made from a material that is magnetized and creates its own persistent magnetic field.

In an example embodiment, the electromechanical lock 100 comprises a polymagnet incorporating correlated patterns of magnets programmed to simultaneously attract and repel as the first permanent magnet 200 and the second permanent magnet 210. With this example embodiment, the permanent magnetic arrangement 109 may be implemented even with a single polymagnet. By using a polymagnet, stronger holding force and shear resistance may be achieved. Additionally, correlated magnets may be programmed to interact only with other magnetic structures that have been coded to respond. This may further improve shielding against the far magnetic break-in field 172.

In an example embodiment, the permanent magnet arrangement 109 comprises one or more additional permanent magnets. These additional permanent magnets are positioned and configured, in the locked position 260, to amplify the near magnetic field 280A, 280B to block the access control mechanism 104 to rotate, and/or to further attenuate the near magnetic field 280A, 280B towards the far magnetic break-in field 172. The additional permanent magnets are positioned and configured, in the open position 400, to amplify the reversed near magnetic field 410A, 410B to release the access control mechanism 109 to rotate, and/or to further attenuate the reversed near magnetic field 410A, 410B towards the far magnetic break-in field 172. These additional permanent magnets may be implemented as described earlier: as separate (stock) permanent magnets or as one or more polymagnets incorporating correlated patterns of additional magnets.

In an example embodiment, the access control mechanism 104 comprises one or more movable magnetic pins 220, 240 configured and positioned to block the access control mechanism 104 to rotate when affected by the near magnetic field 280A, 280B, or to release the access control mechanism 104 to rotate when affected by the reversed near magnetic field 410A, 410B.

In an example embodiment, the magnetic pins 220, 240 may be permanent magnets coated by suitable material withstanding wear and force, or permanent magnets attached to pin-like structures.

In an example embodiment, the movable magnetic pin 220, 240 comprises a main permanent magnet 224, 244 configured and positioned to interact with the permanent magnet arrangement 109, and an auxiliary permanent magnet 222, 242 configured and positioned to attenuate a magnetic field of the main permanent magnet 224, 244 towards the far magnetic break-in field 172.

In an example embodiment illustrated in FIGS. 2A and 4A, the permanent magnet arrangement 109 comprises a first axis 270 between the poles, and the magnetic pin 220, 240 comprises a second axis 272, 274 between the poles, and the first axis 270 is transversely against the second axis 272, 274 both in the locked position 260 and in the open position 400. As shown in FIGS. 2A, 2B, 4A and 4B, the permanent magnet arrangement 109 is facing sideways (=along the first axis 270) the other end (in our example embodiment, the north pole 232 of the first magnetic pin 220, and the north pole 252 of the second magnetic pin 252) of the magnetic pin 220, 240. Note also that the magnetic pins 220, 240 may be positioned so that their ends 232, 252 are facing the opposite ends (along the first axis 270) of the permanent magnet arrangement 109.

Even though Figures illustrate two magnetic pins 220, 240, also such an example embodiment is feasible, wherein only one magnetic pin 220/240 is used.

Also, in an alternative example embodiment, the permanent magnet arrangement 109 comprises the main permanent magnet and the auxiliary permanent magnet (as described earlier for the magnetic pin 220, 240), and the magnetic pin 220, 240 comprises the first permanent magnet and the second permanent magnet (as described earlier for the permanent magnet arrangement 109). In a way, the implementation techniques are reversed from those shown in the Figures.

The positions of the permanent magnets 200, 210 and the magnetic pins 220, 240 and their effect on magnetic fields and the reversed magnetic fields are illustrated in Figures with pole naming conventions, the North pole N and the South pole S: the opposite poles (S-N) attract each other, whereas similar poles (N-N or S-S) repel each other. Consequently, the permanent magnet arrangement 109 comprises the first permanent magnet 200 with the opposite poles 202, 204, and the second permanent magnet 210 with the opposite poles 212, 214. The magnetic pins 220, 240 comprise the main permanent magnets 224, 244 with their opposite poles 230, 232, 250, 252, and the auxiliary permanent magnets 222, 242 with their opposite poles 226, 228, 246, 248.

In an example embodiment, in the locked position 260, the permanent magnet arrangement 109 is configured and positioned to direct the near magnetic field 280A, 280B to block the access control mechanism 104 to rotate 152 with at least one of the following: the near magnetic field 280A obstructs the rotation 152 of the access control mechanism 104, the near magnetic field 280B decouples the rotation 152 from the access control mechanism 104. Respectively, in the open position 400, the permanent magnet arrangement 109 is configured and positioned to direct the reversed near magnetic field 410A, 410B to release the access control mechanism 104 to rotate 152 with at least one of the following: the reversed near magnetic field 410A permits the rotation 152 of the access control mechanism 104, the reversed near magnetic field 410B couples the rotation 152 with the access control mechanism 104.

Let us now explain the opening sequence of the electromechanical lock 100 in more detail.

Figure 3A:
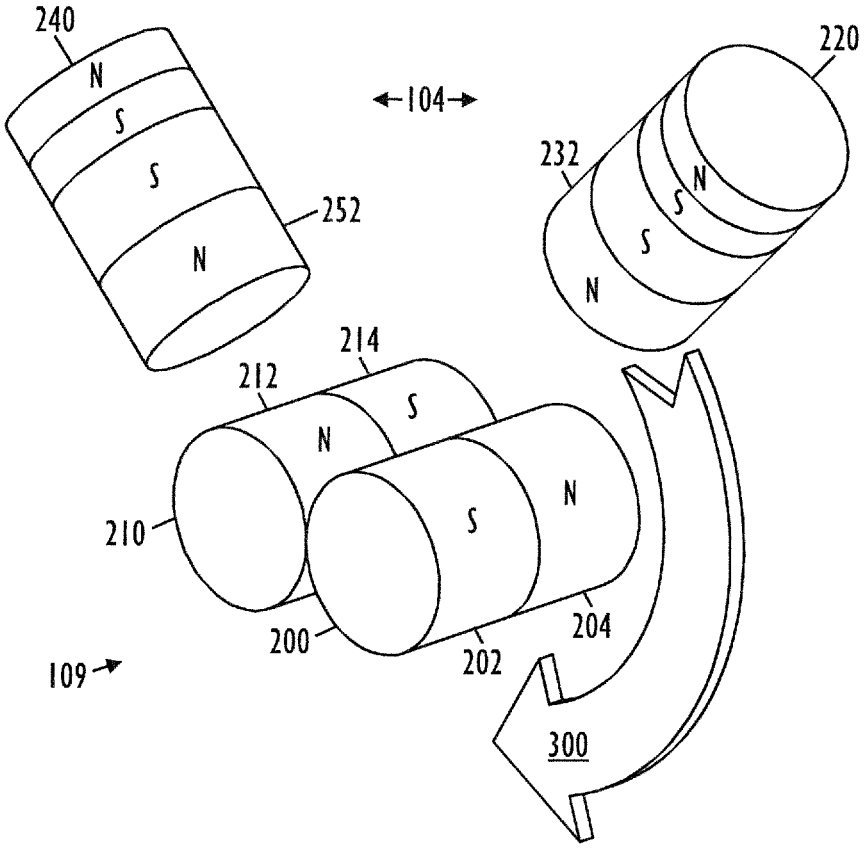
Figure 3B:
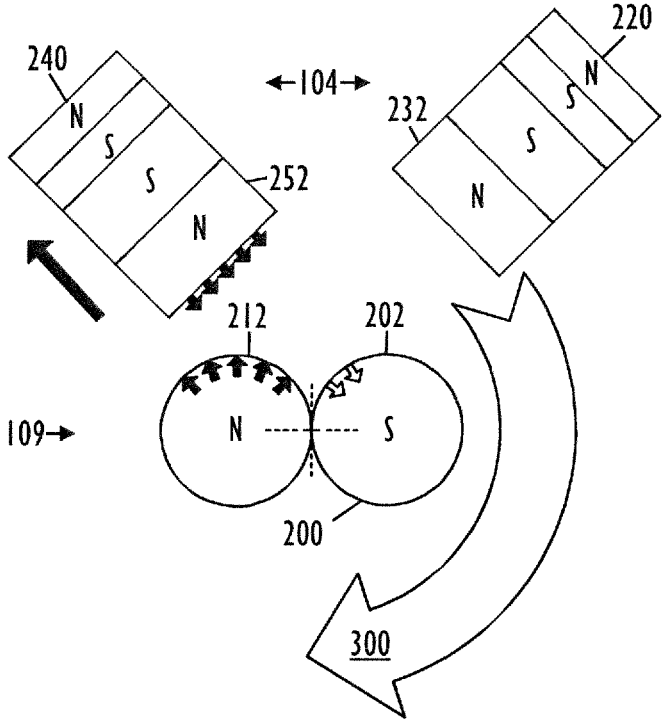

FIGS. 2A and 2B show the permanent magnet arrangement 109 in the locked position 260, FIGS. 3A and 3B show the permanent magnet arrangement 109 in a transition phase from the locked position 260 to the open position 400, and FIGS. 4A and 4B show the permanent magnet arrangement 109 in the open position 400.

Figure 6A:
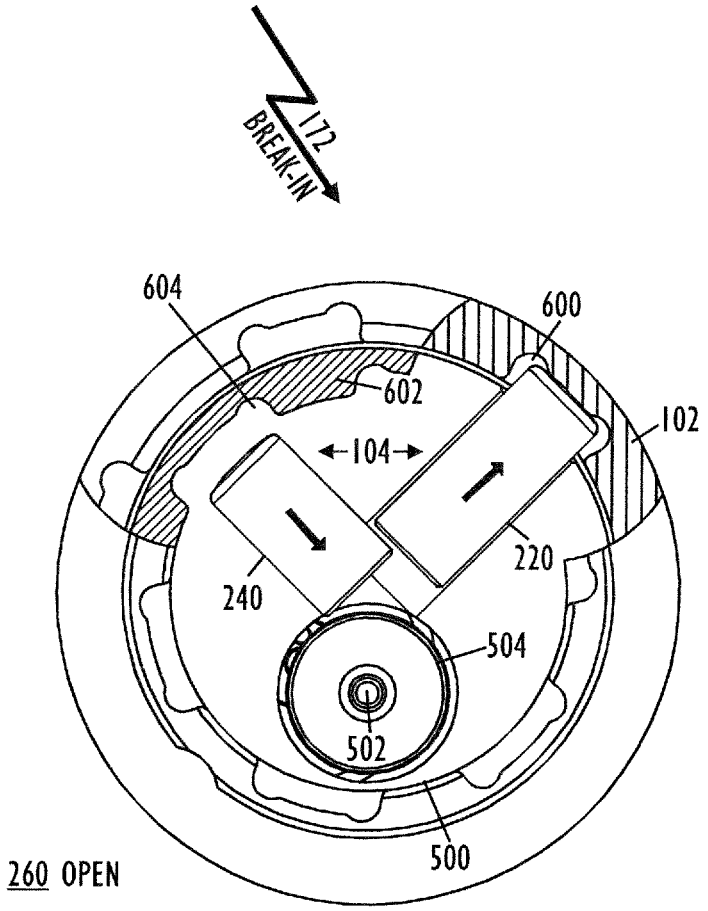

In FIGS. 2A and 2B, the near magnetic field 280A pushes the magnetic pin 220 thereby obstructing the rotation 152 of the access control mechanism 104. This is also illustrated in FIG. 6A, wherein the magnetic pin 220 is pushed into a notch 600 in the lock body 102. At the same time, the near magnetic field 280B pulls the magnetic pin 240 thereby decoupling the rotation 152 from the access control mechanism 104. This is also illustrated in FIG. 6A, wherein the magnetic pin 240 is kept from entering a notch 604 in a structure 602. FIG. 7 illustrates the structure 602 in more detail: it has a plurality of notches 604 and a projection 704. The structure 602 operates as a rotating axle, transmitting the mechanical rotation 152 received from the user of the electromechanical lock 100 to the latch control mechanism 124, thereby retracting 156 the latch 126.

In other words, in the example embodiment illustrated in FIG. 7, a first axle 700 is configured to receive rotation by a user and the second axle 602 is permanently coupled with the latch mechanism 124. In our example embodiment, the rotation 152 by the user is transmitted, in the unlocked position 260 of the actuator 103 through the turning of the first axle 700 in unison with the second axle 602 to the latch mechanism 124 withdrawing 156 the latch 126. However, a "reversed" example embodiment is also feasible: the first axle 700 may be permanently coupled with the latch mechanism 124 and the second axle 602 may be configured to receive the rotation by the user. If we apply this alternate example embodiment to the FIG. 1, this means that the knob 106 (or the key 134 in the keyway 108, or the handle 110) rotates freely in the locked position 260 of the actuator 103, whereas the backend 602 is blocked to rotate, and, in the open position 400 of the actuator 103, the backend 602 is released to rotate and the first axle 700 and the second axle 602 are coupled together.

In an example embodiment illustrated in FIG. 7, the magnetic pins 220, 240 may be fitted into hollows 702. The magnetic pins 220, 240 may be configured to move within the hollows 702 by the forces between them and the permanent magnet arrangement 109.

In FIGS. 3A and 3B, the transition 300 of the permanent magnet arrangement 109 from the locked position 260 to the open position 400 has started. As can be seen, the magnetic pin 240 has started to move.

Figure 6B:
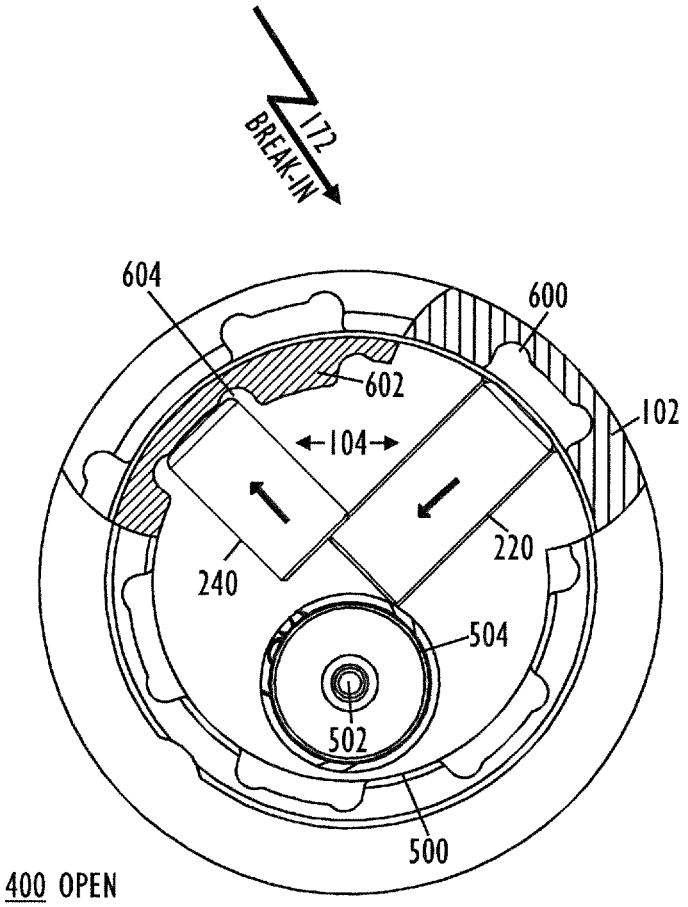

In FIGS. 4A and 4B, the permanent magnet arrangement 109 has arrived to the open position 400. The reversed near magnetic field 410A pulls magnetic pin 220 thereby releasing the rotation 152 of the access control mechanism 104. This is also illustrated in FIG. 6B, wherein the magnetic pin 220 is pulled from the notch 600 in the lock body 102. At the same time, the reversed near magnetic field 410B pushes the magnetic pin 240 coupling the rotation 152 with the access control mechanism 104. This is also illustrated in FIG. 6B, wherein the magnetic pin 240 enters the notch 604 in the structure 602, whereby the structure 602 transmits the mechanical rotation 152 received from the user of the electromechanical lock 100 to the latch control mechanism 124, thereby retracting 156 the latch 126. After this, the door (or another object to which the electromechanical lock 100 is attached to) may be opened.

Figure 5A:
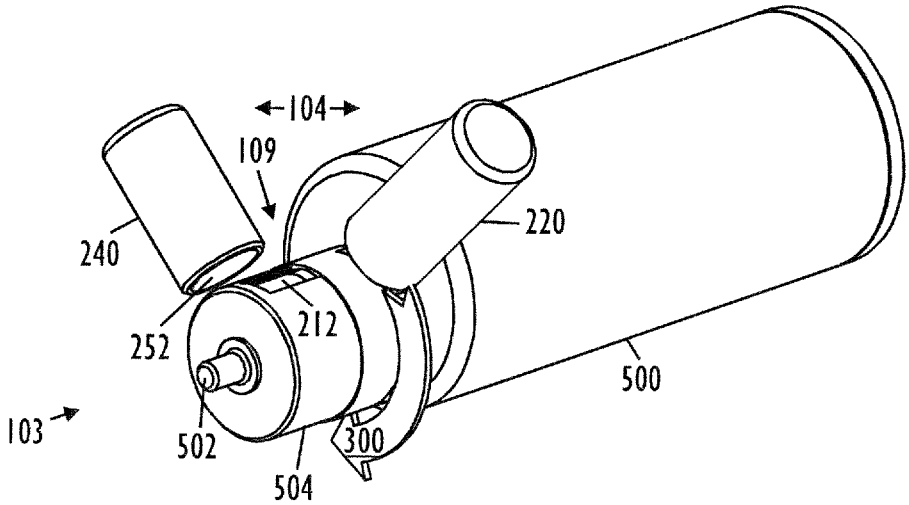
Figure 5B:
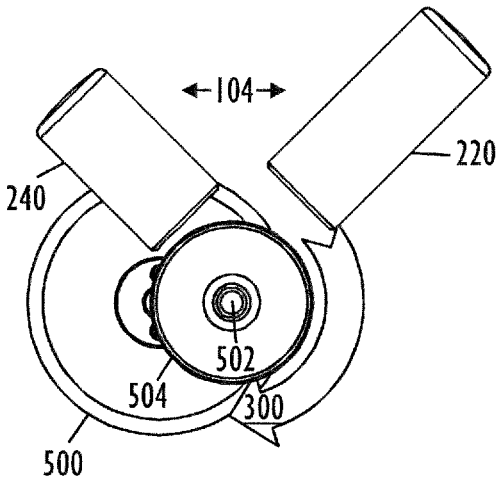
Figure 5C:
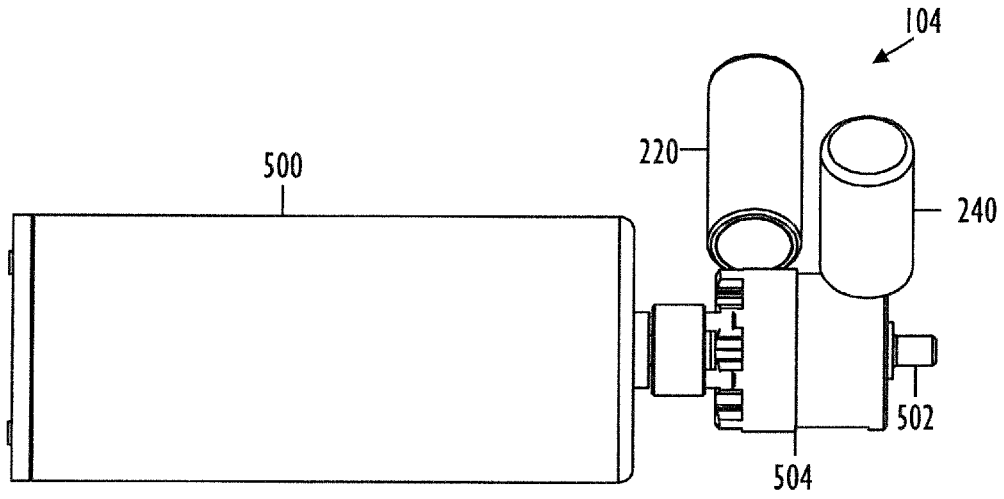

FIGS. 5A, 5B and 5C illustrate the opening sequence as well: the electric motor 500 turns 300 the rotating shaft 502 clockwise, whereby the drive head 504 rotates the permanent magnet arrangement 109 in relation to the magnetic pins 220, 240.

FIGS. 8, 9, 10 and 11 illustrate example embodiments of magnetic fields.

Figure 8:
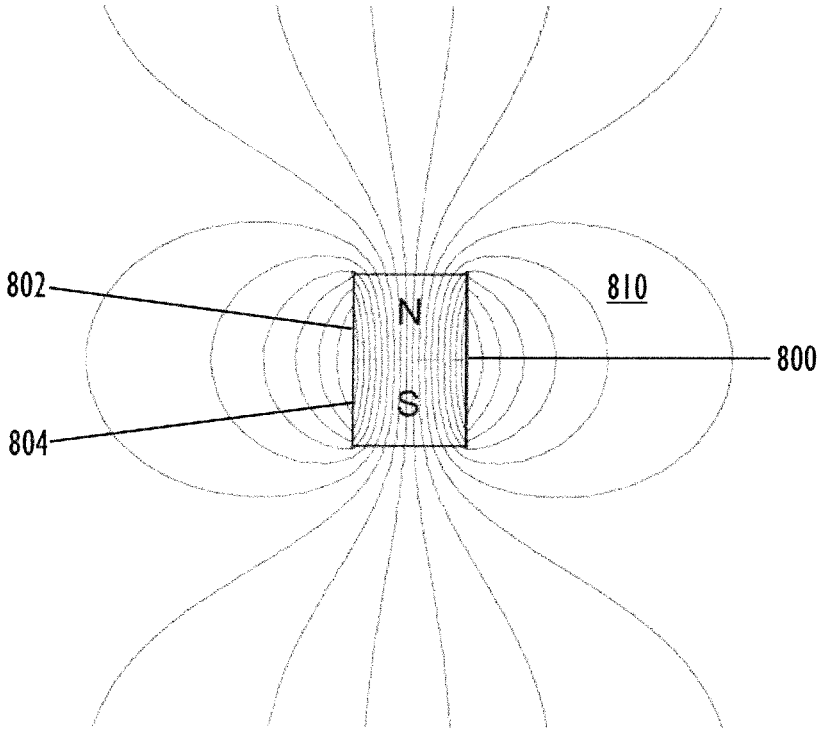
FIGS. 8, 9, 10 and 11 illustrate example embodiments of magnetic fields.
Figure 9:
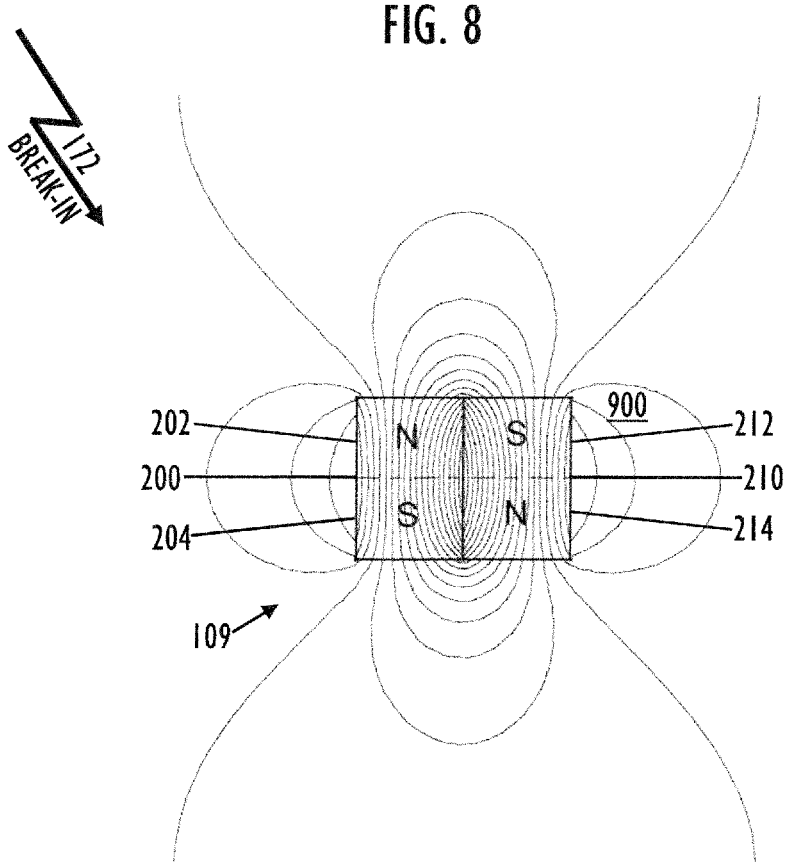

FIG. 8 illustrates a prior art arrangement, wherein a single permanent magnet 800 with two poles 802, 804 is used, whereas FIG. 9 illustrates an example embodiment with the first permanent magnet 200 and the second permanent magnet 210 placed side by side as the permanent magnet arrangement 109.

If we compare the solutions of FIGS. 8 and 9, we note that with the permanent magnet arrangement 109 both the range and the magnitude of the near magnetic field (and the reversed near magnetic field) 900 is smaller than the magnetic field 810 of the single permanent magnet 800. In this way, the permanent magnet arrangement 109 is configured and positioned to attenuate the near magnetic field (or the reversed near magnetic field) 900 towards the far magnetic break-in field 172.

Figure 10:
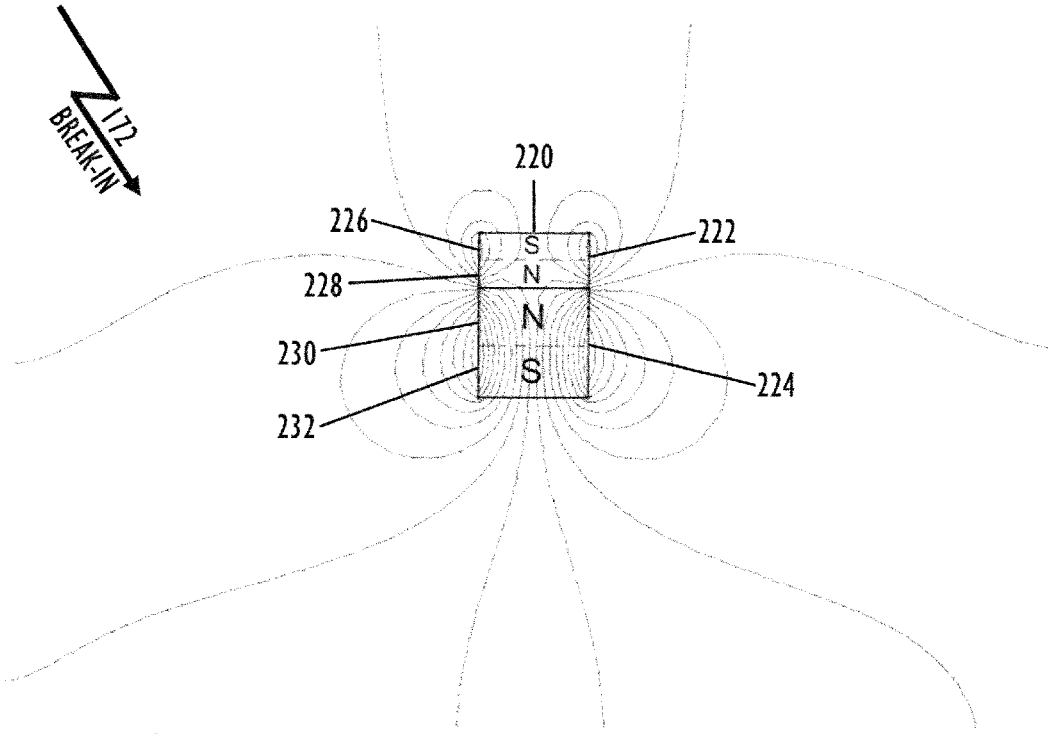

FIG. 10 illustrates the example embodiment with the magnetic pin 220 with the main permanent magnet 224 with the two poles 230, 232 and the auxiliary permanent magnet 222 with the two poles 226, 228. As shown, the main magnetic field is directed towards the south pole 232 of the main permanent magnet 224, which enables good interaction with the permanent magnet arrangement 109 and provides diminishing of the magnetic fields towards the far magnetic break-in field 172.

Figure 11:
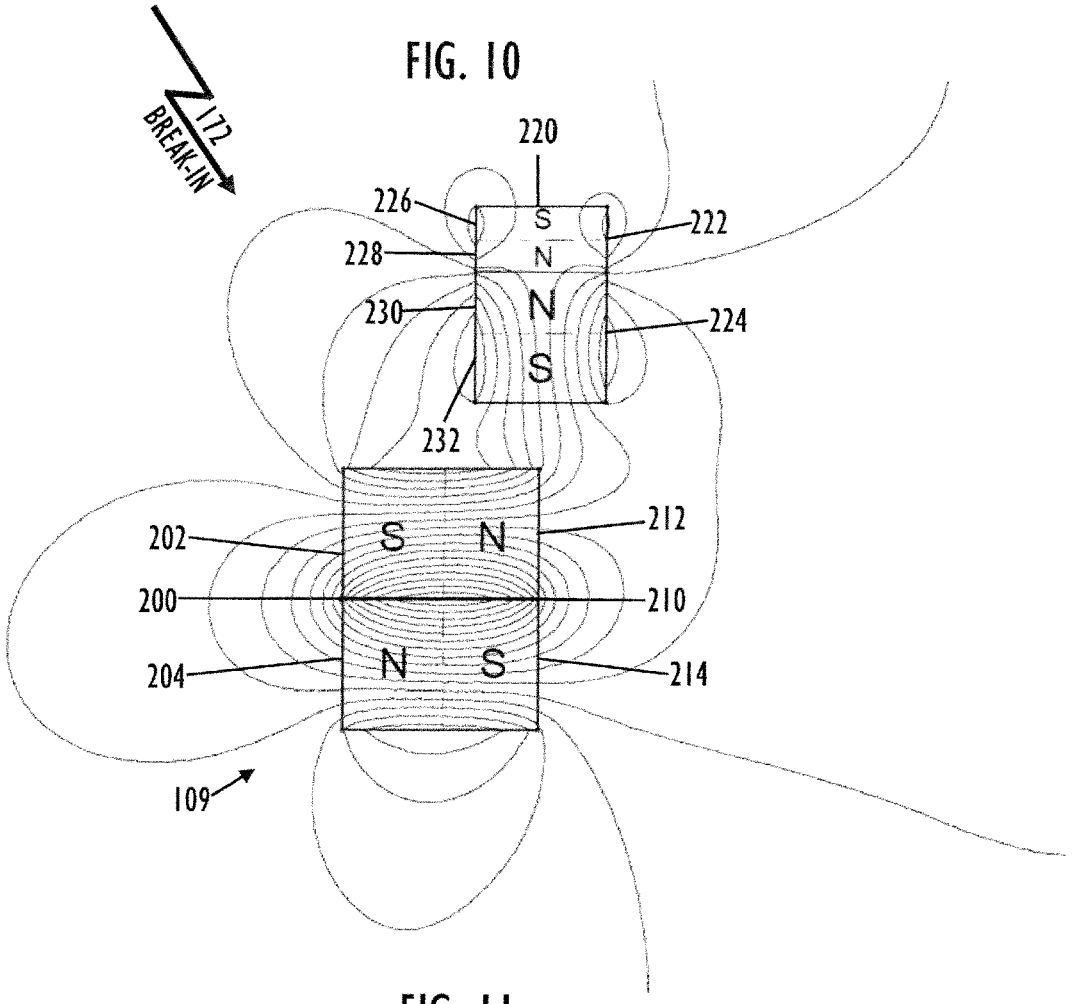

FIG. 11 combines the example embodiments of FIGS. 9 and 10, showing the interaction between the permanent magnetic arrangement 109 and the magnetic pin 220 while the north pole 212 is pulling the magnetic pin 220 from the south pole 232 of the main permanent magnet 224.

Figure 12:
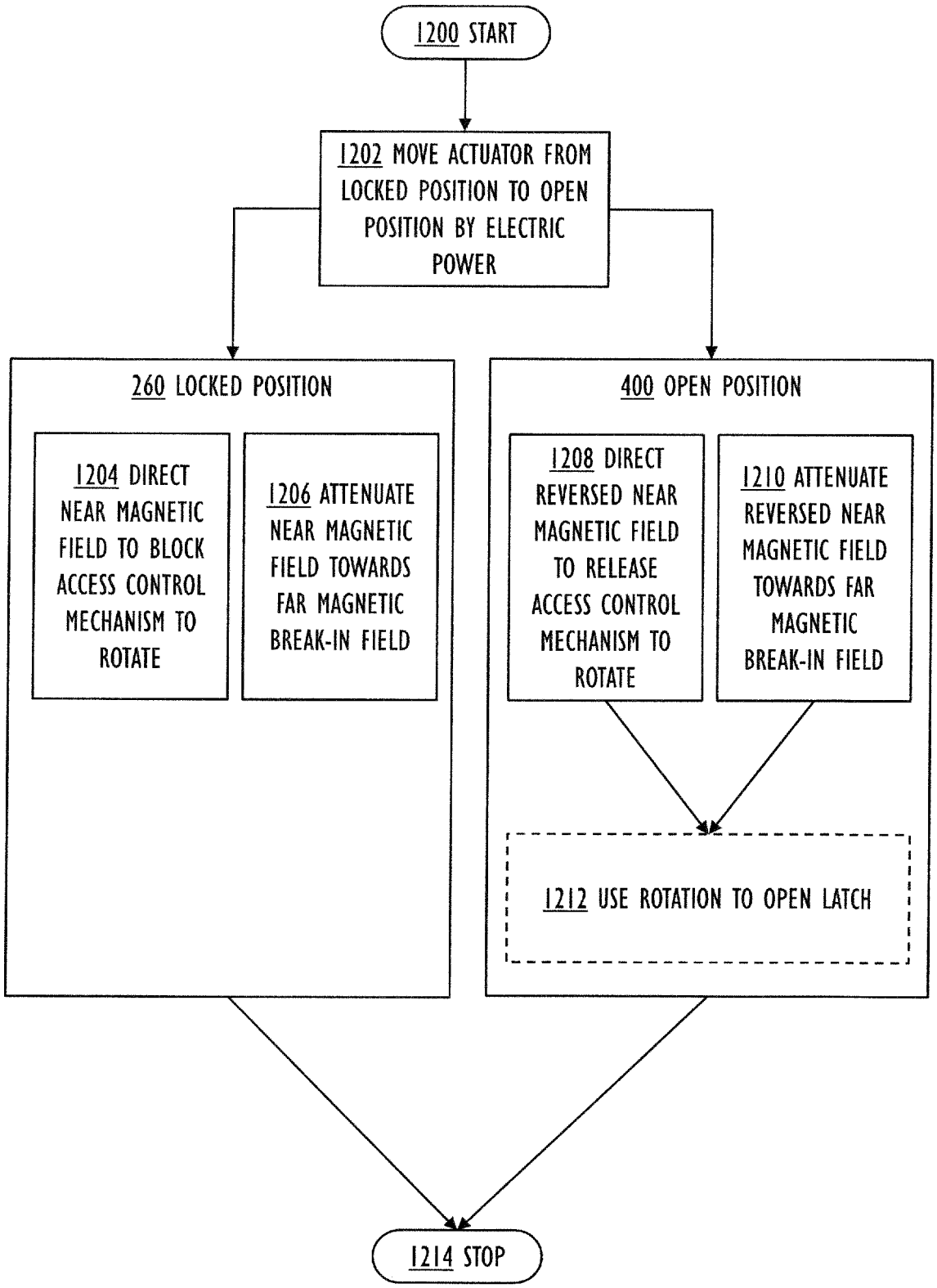
FIG. 12 is a flow chart illustrating example embodiments of a method.

Next, let us study FIG. 12 illustrating a method performed in the electromechanical lock 100. The operations are not strictly in chronological order, and some of the operations may be performed simultaneously or in an order differing from the given ones. Other functions may also be executed between the operations or within the operations and other data exchanged between the operations. Some of the operations or part of the operations may also be left out or replaced by a corresponding operation or part of the operation. It should be noted that no special order of operations is required, except where necessary due to the logical requirements for the processing order.

The method starts in 1200.

In 1202, an actuator is moved from a locked position 260 to an open position 400 by electric power.

In the locked position 260, a permanent magnet arrangement (such as 109) directs a near magnetic field to block an access control mechanism (such as 103) to rotate in 1204, and simultaneously the permanent magnet arrangement attenuates the near magnetic field towards a far magnetic break-in field (such as 172) originating from outside of the electromechanical lock in 1206.

In the open position 400, the permanent magnet arrangement directs a reversed near magnetic field to release the access control mechanism to rotate in 1208, and simultaneously the permanent magnet arrangement attenuates the reversed near magnetic field towards the far magnetic break-in field in 1210. The rotation obtained from the user of the electromechanical lock may now be used to open the latch in 1212.

The method ends in 1214.

The already described example embodiments of the electromechanical lock 100 may be utilized to enhance the method with various further example embodiments. For example, various structural and/or operational details may supplement the method.

It will be obvious to a person skilled in the art that, as technology advances, the inventive concept can be implemented in various ways. The invention and its embodiments are not limited to the example embodiments described above but may vary within the scope of the claims.

The invention claimed is:

1. An electromechanical lock comprising:

an electronic circuit configured to read data from an external source and match the data against a predetermined criterion;

an actuator comprising a permanent magnet arrangement movable from a locked position to an open position by electric power; and an access control mechanism configured to be rotatable by a user;

wherein in the locked position, the permanent magnet arrangement is configured and positioned to create and direct a near magnetic field to block the access control mechanism from rotating, and simultaneously the permanent magnet arrangement is configured and positioned to create and attenuate a range and a magnitude of the near magnetic field towards a far magnetic break-in field originating from outside of the electromechanical lock, whereas in the open position, the permanent magnet arrangement is configured and positioned to create and direct a reversed near magnetic field to release the access control mechanism to rotate, and simultaneously the permanent magnet arrangement is configured and positioned to create and attenuate a range and a magnitude of the reversed near magnetic field towards the far magnetic break-in field, wherein the access control mechanism comprises one or more movable magnetic pins configured and positioned to block the access control mechanism from rotating when affected by the near magnetic field, and configured to release the access control mechanism to rotate when affected by the reversed near magnetic field, wherein the permanent magnet arrangement comprises a first axis between poles, and the magnetic pin comprises a second axis between poles, and the first axis is transversely against the second axis both in the locked position and in the open position, wherein the one or more movable magnetic pins comprise a main permanent magnet configured and positioned to interact with the permanent magnet arrangement, and an auxiliary permanent magnet configured and positioned to attenuate a magnetic field of the main permanent magnet towards the far magnetic break-in field, wherein in transitioning from the locked position to the open position, the permanent magnet arrangement begins to rotate in relation to the one or more movable magnetic pins of the access control mechanism, causing movement of the one or more movable magnetic pins, wherein the one or more movable magnetic pins comprise first and second movable magnetic pins, wherein in the locked position, the near magnetic field pushes the first magnetic pin to obstruct rotation of the access control mechanism and pulls the second magnetic pin to decouple the rotation from the access control mechanism, wherein in the open position, the reversed near magnetic field pulls the first magnetic pin to release the rotation of the access control mechanism and pushes the second magnetic pin coupling the rotation of the access control mechanism with the access control mechanism, and wherein the second magnetic pin moves during the transition from the locked position to the open position.

2. The electromechanical lock of claim 1, wherein:

the permanent magnet arrangement comprises a first permanent magnet and a second permanent magnet configured and positioned side by side so that opposite poles of the first permanent magnet and the second permanent magnet are side by side;

wherein in the locked position, the first permanent magnet is configured and positioned nearer to the access control mechanism than the second permanent magnet so that the near magnetic field is directed to block the access control mechanism to rotate, and simultaneously the second permanent magnet is configured and positioned to diminish the near magnetic field towards the far magnetic break-in field, whereas in the open position, the second permanent magnet is configured and positioned nearer to the access control mechanism than the first permanent magnet so that the reversed near magnetic field is directed to release the access control mechanism to rotate, and simultaneously the first permanent magnet is configured and positioned to diminish the reversed near magnetic field towards the far magnetic break-in field.

3. The electromechanical lock of claim 2, comprising the first permanent magnet and the second permanent magnet as separate permanent magnets fixed to each other.

4. The electromechanical lock of claim 2, further comprising a polymagnet incorporating correlated patterns of magnets programmed to simultaneously attract and repel as the first permanent magnet and the second permanent magnet.

5. The electromechanical lock of claim 1, wherein the permanent magnet arrangement comprises one or more additional permanent magnets positioned and configured, in the locked position, to amplify the near magnetic field to block the access control mechanism from rotating, and/or to further attenuate the near magnetic field towards the far magnetic break-in field, whereas in the open position, to amplify the reversed near magnetic field to release the access control mechanism to rotate, and/or to further attenuate the reversed near magnetic field towards the far magnetic break-in field.

6. The electromechanical lock of claim 1, wherein:

in the locked position, the permanent magnet arrangement is configured and positioned to direct the near magnetic field to block the access control mechanism from rotating by the near magnetic field obstructing the rotation of the access control mechanism, and/or the near magnetic field decoupling the rotation from the access control mechanism, and in the open position, the permanent magnet arrangement is configured and positioned to direct the reversed near magnetic field to release the access control mechanism to rotate by the reversed near magnetic field permitting the rotation of the access control mechanism, and/or the reversed near magnetic field coupling the rotation with the access control mechanism.

7. The electromechanical lock of claim 1, wherein the actuator also comprises a moving shaft coupled with the permanent magnet arrangement, and the moving shaft is configured to move the permanent magnet arrangement from the locked position to the open position by the electric power.

8. A method in an electromechanical lock, comprising:

moving an actuator from a locked position to an open position by electric power;

in the locked position, creating and directing, by a permanent magnet arrangement, a near magnetic field to block an access control mechanism from rotating, and simultaneously creating and attenuating, by the permanent magnet arrangement, a range and a magnitude of the near magnetic field towards a far magnetic break-in field originating from outside of the electromechanical lock; and in the open position, creating and directing, by the permanent magnet arrangement, a reversed near magnetic field to release the access control mechanism to rotate, and simultaneously creating and attenuating, by the permanent magnet arrangement, a range and a magnitude of the reversed near magnetic field towards the far magnetic break-in field, wherein the access control mechanism comprises one or more movable magnetic pins configured and positioned to block the access control mechanism to rotate when affected by the near magnetic field, and configured to release the access control mechanism to rotate when affected by the reversed near magnetic field, wherein the permanent magnet arrangement comprises a first axis between poles, and the magnetic pin comprises a second axis between poles, and the first axis is transversely against the second axis both in the locked position and in the open position, wherein the one or more movable magnetic pins comprise a main permanent magnet configured and positioned to interact with the permanent magnet arrangement, and an auxiliary permanent magnet configured and positioned to attenuate a magnetic field of the main permanent magnet towards the far magnetic break-in field, wherein in transitioning from the locked position to the open position, the permanent magnet arrangement begins to rotate in relation to the one or more movable magnetic pins of the access control mechanism, causing movement of the one or more movable magnetic pins, wherein the one or more movable magnetic pins comprise first and second movable magnetic pins, wherein in the locked position, the near magnetic field pushes the first magnetic pin to obstruct rotation of the access control mechanism and pulls the second magnetic pin to decouple the rotation from the access control mechanism, wherein in the open position, the reversed near magnetic field pulls the first magnetic pin to release the rotation of the access control mechanism and pushes the second magnetic pin coupling the rotation of the access control mechanism with the access control mechanism, and wherein the second magnetic pin moves during the transition from the locked position to the open position.

9. The method of claim 8, wherein:

the permanent magnet arrangement comprises a first permanent magnet and a second permanent magnet configured and positioned side by side so that opposite poles of the first permanent magnet and the second permanent magnet are side by side;

wherein in the locked position, the first permanent magnet is configured and positioned nearer to the access control mechanism than the second permanent magnet so that the near magnetic field is directed to block the access control mechanism to rotate, and simultaneously the second permanent magnet is configured and positioned to diminish the near magnetic field towards the far magnetic break-in field, whereas in the open position, the second permanent magnet is configured and positioned nearer to the access control mechanism than the first permanent magnet so that the reversed near magnetic field is directed to release the access control mechanism to rotate, and simultaneously the first permanent magnet is configured and positioned to diminish the reversed near magnetic field towards the far magnetic break-in field.

10. The method of claim 9, wherein the first permanent magnet and the second permanent magnet are separate permanent magnets fixed to each other.

11. The method of claim 9, wherein a polymagnet incorporates correlated patterns of magnets programmed to simultaneously attract and repel as the first permanent magnet and the second permanent magnet.

12. The method of claim 8, wherein the permanent magnet arrangement comprises one or more additional permanent magnets positioned and configured, in the locked position, to amplify the near magnetic field to block the access control mechanism from rotating, and/or to further attenuate the near magnetic field towards the far magnetic break-in field, whereas in the open position, to amplify the reversed near magnetic field to release the access control mechanism to rotate, and/or to further attenuate the reversed near magnetic field towards the far magnetic break-in field.

13. The method of claim 8, wherein:

in the locked position, the permanent magnet arrangement is configured and positioned to direct the near magnetic field to block the access control mechanism from rotating by the near magnetic field obstructing the rotation of the access control mechanism, and/or the near magnetic field decoupling the rotation from the access control mechanism, and in the open position, the permanent magnet arrangement is configured and positioned to direct the reversed near magnetic field to release the access control mechanism to rotate by the reversed near magnetic field permitting the rotation of the access control mechanism, and/or the reversed near magnetic field coupling the rotation with the access control mechanism.

14. The method of claim 8, wherein the actuator also comprises a moving shaft coupled with the permanent magnet arrangement, and the moving shaft is configured to move the permanent magnet arrangement from the locked position to the open position by the electric power.

15. The electromechanical lock of claim 1, wherein the auxiliary permanent magnet is positioned on top of the main permanent magnet so that similar poles, North and North, or South and South, of the auxiliary permanent magnet and the main permanent magnet are next to each other in the one or more movable magnetic pins.

16. The method of claim 8, wherein the auxiliary permanent magnet is positioned on top of the main permanent magnet so that similar poles, North and North, or South and South, of the auxiliary permanent magnet and the main permanent magnet are next to each other in the one or more movable magnetic pins.

17. The electromechanical lock of claim 1, wherein, for each of the first and second movable magnetic pins, the auxiliary permanent magnet is positioned on top of the main permanent magnet so that similar poles, North and North, or South and South, of the auxiliary permanent magnet and the main permanent magnet contact each other.

18. The electromechanical lock of claim 1, wherein, for each of the first and second movable magnetic pins, the auxiliary permanent magnet is positioned on top of the main permanent magnet so that similar poles, North and North, or South and South, of the auxiliary permanent magnet and the main permanent magnet are in a plane of contact and axially aligned with each other.

19. The electromechanical lock of claim 2, wherein the first and second movable magnetic pins are rotatable in relation to a body of the lock when the lock is opening.

* * * * *